United States Patent [19]

DeRosia

[11] Patent Number: 4,887,728

[45] Date of Patent: Dec. 19, 1989

[54] ADJUSTABLE CLOTHES DRYING UNIT

[76] Inventor: Francis L. DeRosia, P.O. Box 1289, Evanston, Wyo. 82931-1289

[21] Appl. No.: 203,090

[22] Filed: Jun. 7, 1988

[51] Int. Cl.[4] ..... A47B 47/00

[52] U.S. Cl. ..... 211/208; 211/197; 248/333

[58] Field of Search ..... 211/208, 207, 197, 117, 211/119.03, 119.12, 119.17; 248/345, 317-334.1, 342-344, 59, 297.3

[56] References Cited

U.S. PATENT DOCUMENTS

| | | | |
|---|---|---|---|
| 32,147 | 4/1861 | Robinson | 248/333 X |
| 495,409 | 4/1893 | Fry | 248/333 X |
| 766,890 | 8/1904 | Newberg . | |
| 952,053 | 3/1910 | Tarleton | 248/59 |
| 983,701 | 2/1911 | Gardiner | 248/345 |
| 1,222,242 | 4/1917 | Payne et al. . | |
| 2,195,162 | 3/1940 | Baxter | 248/333 X |
| 2,670,917 | 3/1954 | Hoffman | 248/59 X |
| 3,989,217 | 11/1976 | Friedman | 248/297.3 X |
| 4,047,687 | 9/1977 | Turner | 248/333 X |
| 4,550,840 | 11/1985 | Deursen | 211/197 |

FOREIGN PATENT DOCUMENTS 836849 4/1952 Fed. Rep. of Germany .

*Primary Examiner*—Alvin C. Chin-Shue

*Attorney, Agent, or Firm*—Fleit, Jacobson, Cohn, Price, Holman & Stern

[57] ABSTRACT

An adjustable clothes drying unit including a ceiling mounted support receiving a vertically elongated post slidably therethrough. The post is provided with adjustable pins for engagement with the support in both selectively locking the post in a vertically adjusted position and defining the lower limit of movement of the post. The lower end of the post carries a rotatably mounted drying rack.

7 Claims, 1 Drawing Sheet

ADJUSTABLE CLOTHES DRYING UNIT

BACKGROUND OF THE INVENTION

FIELD OF THE INVENTION

The present invention generally relates to an adjustable clothes drying unit, and is more particularly concerned with a ceiling mounted unit which includes a vertically adjustable clothes drying rack capable of being positioned in a lowered clothes receiving position, as well as in a raised retracted position wherein the unit is stored in an out-of-the-way location.

SUMMARY OF THE INVENTION

It is an object of this invention to provide a unique construction, with regard to a clothes drying unit, which is equally adaptable for relatively small installations, including a small drying rack of approximately two feet for installation in bathrooms or the like, as well as larger installations wherein the drying rack can be five to eight feet for use in a utility room, back porch or garage.

In conjunction with the above object, it is considered particularly significant that the drying unit is both adjustable and substantially completely retractable so as to, when not specifically being used to dry clothes, be positioned so as to not interfere with the normal use of the area.

Other significant advantages residing in the present invention comprise the provision of a rotating rack, a unit which is of a simple although structurally stable construction, and a unit which can be easily and rapidly installed by the homeowner.

Basically, the adjustable clothes drying unit of this invention includes a vertically adjustable post, a support therefor which mounts to the ceiling, normally a pair of adjacent joists, movable position fixing pins for enabling an adjustment in the position of the post, and a clothes rack rotatably mounted on the lower end of the post.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
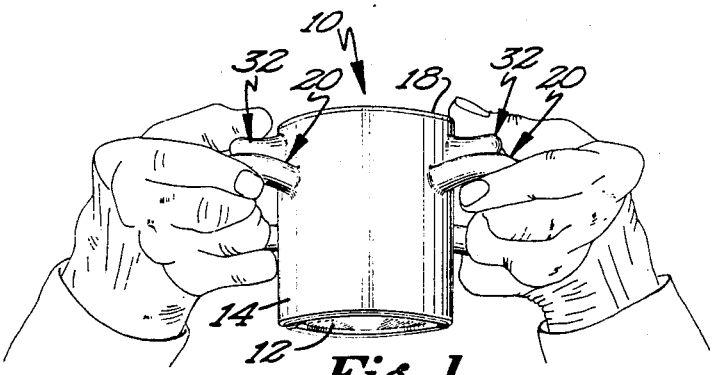
FIG. 1 is a side elevational view of the clothes drying unit in its extended position.

Referring now more specifically to the drawings, reference numeral 10 is used to generally designate the adjustable clothes drying unit comprising the present invention. This clothes drying unit 10 basically includes a ceiling mounted support 12, a vertically elongated post 14 and a clothes suspending rack 16.

The support 12 includes a downwardly directed domed housing 18 which is to be affixed to the ceiling

20 of an appropriate area by means of a pair of diametrically opposed lag bolts or screws 22 extending through the housing and into the ceiling support structure, normally a pair of adjacent joists 24. It will of course be appreciated that should the installation be in a garage or the like, the joists 24 may be exposed, in which case, the support housing 18 will merely be drawn up tightly thereagainst by the mounting screws 22.

A hollow support tube 26 extends vertically through the center of the housing 18 and is rigidly affixed thereto so as to constitute an integral part thereof. This tube 26, as shown in the drawings, projects below the housing 18 so as to define a depending collar 28 having a pair of opposed pin locking bayonet slots 30. The upper end of the support tube extends through an enlarged opening 32 provided in the ceiling or ceiling board, providing an upper annular bearing edge 34. This upper bearing edge 34 and the depending slotted collar 28 cooperate in positioning the vertically adjustable post 14, and thus constitute the significant portions of the support 12. As such, rather than utilizing the tube 26, a collar equivalent to the collar 28 could be affixed directly to the rounded bottom wall of the housing 18 with the upper bearing edge being defined by a flat centrally apertured top wall provided on the housing 18. In any event, the central passage for the post 14 through the support will of course have to be maintained.

The post 14 itself is in the nature of an elongated hollow tube having a series of vertically spaced transverse pin receiving passages 36 therethrough, each of these passages 36 actually being defined by a pair of diametrically opposed holes in the tubular body of the post 14. The lower end of the post 14 has a flat plate 38 rigidly affixed thereto, this plate 38 projecting outwardly from the post 14 completely thereabout and including a depending loop handle 40 for facilitating a grasping and manipulation of the post 14.

Figure 3:
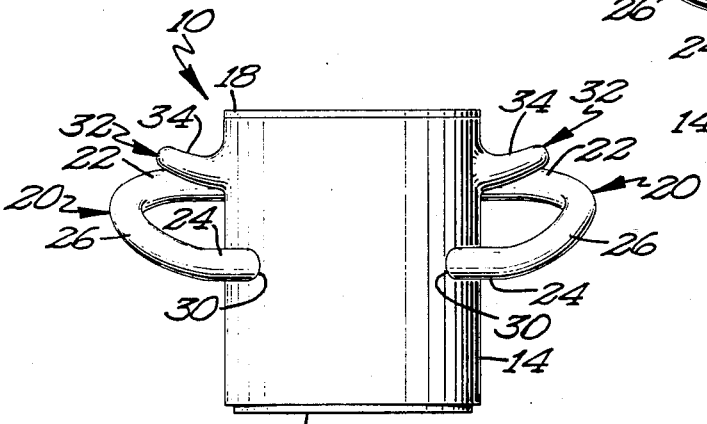
FIG. 3 is an enlarged cross-sectional view taken substantially on a plane passing along section line 3—3 on FIG. 1 with the retracted position of the unit being illustrated in broken lines.
Figure 4:
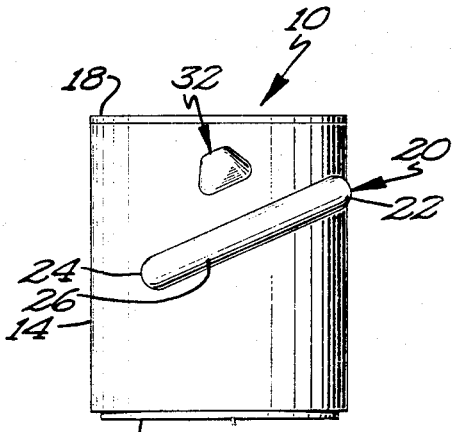
FIG. 4 is an enlarged cross-sectional view taken substantially on a plane passing along section line 4—4 on FIG. 3.
Figure 5:
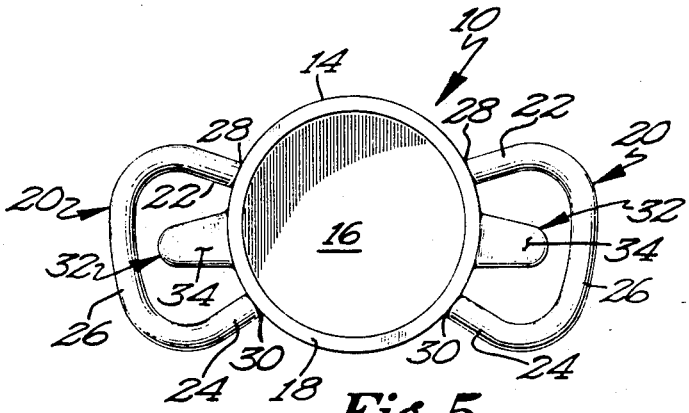

An upper positioning pin 42 is inserted through a selected one of the upper pin passages 36 for engagement with the annular bearing surface 34 upon a lowering of the post 14 so as to define the lower limit of the unit. As will be noted in FIG. 3, the illustrated upper positioning pin 42 has been inserted in the second from the top pin passage 36. Thus, if a lower positioning of the extended unit is desired, the pin 42 can be shifted to the uppermost pin passage 36. By the same token, a movement of the upper positioning pin 42 to a lower passage 36 will result in a decrease in the extended length of the post 14.

A lower positioning pin 44 is also provided, this pin 44 normally being positioned through the lowermost post pin passage 36 for a selective reception within the opposed bayonet slots 30 so as to, upon a rotation of the post 14 so as to position the opposite projecting ends of the pin 44 in the offset sections of the slots 30, lock the post in its elevated or collapsed position. The lower positioning pin 44 ca also be vertically adjusted to the other pin passages 36 occurring below the collar 28 so as to not only vary the collapsed height of the unit 10, but also vary the extended position of the unit 10.

For example, should the user of the unit wish to temporarily hang longer than normal clothes on the rack 16, the lower positioning pin 44 can be moved up one or two passages 36 and used to lock the post 14 in what might be considered a partially extended position, thus eliminating the necessity of adjusting the upper positioning pin 42 each time a temporary variation in the extended position of the unit is desired. Of course, when collapsing the unit, the lower positioning pin 44 will again be inserted in the lowermost pin passage 36. Incidentally, both the pins 42 and 44 are of a size so as to be slidably although relatively snugly accommodated in the passages 36 whereby any tendency for an accidental displacement of the pins will be avoided.

Figure 2:
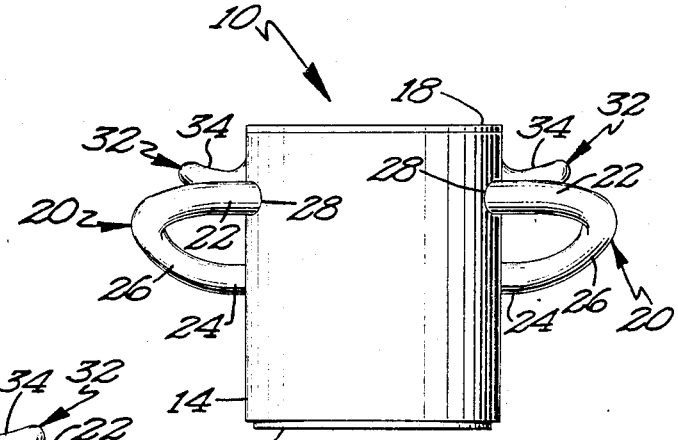
FIG. 2 is a bottom plan view of the drying unit.

The drying rack 16 itself includes a central sleeve 46 which is rotatably received about the lower end portion of the post 14 and retained thereon by the flat bottom plate 38. In addition, the rack includes a plurality, normally four, of radially outwardly extending support arms 48 rigidly affixed directly to the sleeve 46 and indirectly thereto by angled braces 50, the arms 48 themselves being inclined slightly upward. The rack is completed by extending lines or wires 52 thereabout through appropriate holes provided in the arms 48, defining in effect a concentric series of rectangular lines as will be best appreciated from FIG. 2.

From the foregoing, it will be appreciated that a unique adjustable clothes drying unit has been defined, this unit being of a construction easily adapted to the formation of a unit incorporating either a small bathroom mounted rack of from five to eight feet which can be positioned in a utility room, garage or the like. In each instance, the unit is collapsible so as to position the drying rack, during periods of non-use, in an elevated position immediately adjacent the ceiling or ceiling joists so as to clear the entire area therebelow for use for the tasks normally assigned to such areas. The actual manipulation of the unit is effected through a depending easily grasped handle which allows the user to quickly grasp and position the unit, whether in its lowered in use position or in its raised storage position.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An adjustable clothes drying unit comprising a support tube mountable on an overhead structure, said support tube defining a vertical passage therethrough, said passage having upper and lower end portions, an elongated post slidably received through and beyond the upper and lower end portions of said passage for vertical adjustment therein, said post having upper and lower end portions, a drying rack mounted on the lower end portion of said post, upper and lower post positioning means on said post, retaining means on the upper and lower end portions of said support tube selectively engageable with said post positioning means upon a vertical adjustment of said post for fixing the post, and the drying rack therewith, in a vertically adjusted position, and means for longitudinally adjusting the position of the upper and lower post positioning means on said post for varying the vertical orientation of said post upon engagement of either positioning means with a corresponding retaining means.

2. The unit of claim 1, wherein said upper and lower post positioning means comprise a pair of elongated rigid pins, said means for longitudinally adjusting the position of the upper and lower post positioning means comprising a series of transverse apertures through said post at longitudinally spaced points therealong for the selective reception of said pins.

3. The unit of claim 2, wherein the retaining means on the lower end portion of said support tube comprises slot means selectively receiving the pin comprising the lower post positioning means for locking said post against downward movement.

4. The unit of claim 2, including means rotatably mounting said drying rack on said post.

5. An adjustable clothes drying unit comprising an overhead support, said support defining a vertical passage therethrough, said passage having upper and lower portions, an elongated post slidably received through and beyond the upper and lower portions of said passage for vertical adjustment therein, said post having upper and lower end portions, a drying rack mounted on the lower end portion of said post, upper and lower post positioning means on said post, retaining means on said support at the upper and lower portions of said passage selectively engageable with said post positioning means upon a vertical adjustment of said post for fixing the post, and the drying rack therewith, in a vertically adjusted position, and means for longitudinally adjusting the position of the upper and lower post positioning means on said post for varying the vertical orientation of said post upon engagement of either positioning means with a corresponding retaining means.

6. The unit of claim 5, wherein said upper and lower post positioning means comprise a pair of elongated rigid pins, said means for longitudinally adjusting the position of the upper and lower post positioning means comprising a series of transverse apertures through said post at longitudinally spaced points therealong for the selective reception of said pins.

7. An adjustable clothes drying unit supported from an overhead supporting structure comprising a support adapted to be supported from the overhead supporting structure, said support including a housing adapted to be affixed to the overhead supporting structure, a hollow support tube rigidly affixed to the housing and extending above and below the housing and terminating in open ends, the lower end of the support tube including a pair of opposed bayonet slots communicating with the lower end of the support tube, the upper end of the support tube forming a bearing edge, an elongated post extending vertically through the support tube and longitudinally adjustable therein for movement of the post in relation to the support tube with the post having an upper end extending above the upper end of the support tube and a lower end extending below the lower end of the support tube, said post including a plurality of vertically spaced transverse apertures therein, an upper positioning pin extending transversely of the post and received in a selected transverse aperture for supporting engagement with the bearing edge on the upper end of the support tube, a lower transverse pin extending through a selected aperture in said post below the lower end of the support tube and extending outwardly from diametric opposite portions of the post for releasable engagement with the bayonet slots, said upper transverse pin supporting the post in lowered adjustable position when the upper transverse pin engages the upper bearing of the support tube, said lower transverse pin supporting the post in elevated adjustable position when the lower transverse pin engages the bayonet slots, and a drying rack mounted on the lower end of the post with the adjustable upper and lower pins and their association with the bearing edge at the upper end of the support tube and the bayonet slots at the lower end of the support tube enabling the drying rack to be adjustably supported in a lowered position and adjustably supported in an elevated position.

* * * * *